US006659313B1

(12) United States Patent
MacMurdo

(10) Patent No.: US 6,659,313 B1
(45) Date of Patent: Dec. 9, 2003

(54) MAGNETIC TUBE AND DELIVERY APPARATUS

(76) Inventor: Alex MacMurdo, 5318 Harriet Ave. South, Minneapolis, MN (US) 55419

( * ) Notice: Subject to any disclaimer, the term of this patent is extended or adjusted under 35 U.S.C. 154(b) by 0 days.

(21) Appl. No.: 10/205,875

(22) Filed: Jul. 24, 2002

(51) Int. Cl.[7] ..... B67D 3/00
(52) U.S. Cl. ..... 222/538; 222/530
(58) Field of Search ..... 222/530, 538, 222/402.1; 239/337, 390, 600

(56) References Cited

U.S. PATENT DOCUMENTS

| | | | | | |
|---|---|---|---|---|---|
| 4,857,594 | A | | 8/1989 | Lakshmanan et al. | 525/98 |
| 5,397,843 | A | | 3/1995 | Lakshmanan et al. | 525/240 |
| 5,409,145 | A | * | 4/1995 | Payne | 222/212 |
| 5,478,891 | A | | 12/1995 | Lakshmanan et al. | 525/240 |
| 5,482,982 | A | | 1/1996 | Lakshmanan et al. | 524/68 |
| 5,601,216 | A | * | 2/1997 | Visco | 222/538 |
| 5,645,198 | A | * | 7/1997 | Stern et al. | 222/402.1 |
| 5,675,318 | A | * | 10/1997 | Hunt, Jr. | 340/540 |
| 5,772,084 | A | * | 6/1998 | Yale et al. | 222/402.1 |
| 5,824,040 | A | | 10/1998 | Cox et al. | 623/1 |
| 5,979,706 | A | * | 11/1999 | Grussmark | 222/93 |
| 6,315,152 | B1 | * | 11/2001 | Kalisz | 220/735 |
| 6,412,671 | B1 | * | 7/2002 | Riley et al. | 222/538 |

* cited by examiner

*Primary Examiner*—Gregory L. Huson
*Assistant Examiner*—Azy Kokabi
(74) *Attorney, Agent, or Firm*—Vidas, Arrett & Steinkraus, P.A.

(57) ABSTRACT

A combination container and applicator where the container has an outside surface and an interior and an extension tube which is magnetically attracted to the container outside surface such that when placed on the container the extension tube becomes releasably magnetically affixed to the outside surface.

11 Claims, 3 Drawing Sheets

MAGNETIC TUBE AND DELIVERY APPARATUS

CROSS-REFERENCE TO RELATED APPLICATIONS

Not Applicable

STATEMENT REGARDING FEDERALLY SPONSORED RESEARCH

Not Applicable

BACKGROUND OF THE INVENTION

Aerosol spray containers typically have contents under pressure where the contents are delivered through a very small orifice in a nozzle disposed on top of the canister. A valve is interposed between the nozzle and the pressurized interior of the canister. Typically, the valve is operated by pressing the top of the nozzle assembly, so as to cause the contents of the canister to spray from the nozzle in a conical spray pattern that broadcasts the sprayed contents onto an item.

In many instances it is desirable to direct the spray into a more precise area than achieved by the conical spray pattern typically produced. For this reason extension tubes have been utilized. These tubes have enabled the delivery of the contents of the canister onto a precise area and for reaching areas which are relatively inaccessible. The tube is sized to fit a tube receiving bore that is concentric with the spray orifice of the nozzle, so as to allow the contents of the canister to travel from the spray orifice, through the extension tube, and out the distal end of the spray tube remote from the spray orifice. The extension tube is typically a flexible plastic tube about three or four inches (7.6 to 10.2 cm.) in length, typically having an outer diameter of about 2 mm and having an inner diameter of about 0.7 mm.

By positioning the distal end of the spray tube into the relatively inaccessible area while the proximal end of the spray tube is received into the tube-receiving bore in the nozzle, the contents of the canister may be efficiently and easily delivered into that previously inaccessible area without spraying the contents onto an adjacent area of the item.

A well-known problem in this prior art is that of attaching the extension tube to the canister in such a way that the tube is readily on hand and accessible for future use. Efforts to solve this problem have been unsatisfactory. The spray tube extension generally is only used for certain applications, it is not practical or desirable to permanently affix the spray tube extension to the aerosol nozzle assembly, and, for this reason, the spray tube extension is sized to fit a tube receiving bore that is concentric with the spray orifice of the nozzle for those certain uses of the aerosol spray canister which require such an extension.

Well-known prior art solutions to the problem of affixing the spray tube extension to the aerosol canister have been primarily through mechanical means.

One such use has been affixing the tube to the surface of the canister with cellophane tape. The use of cellophane tape is problematic because the tape and adhesive deteriorates over time as the tape is repeatedly removed and reapplied or the tape is eventually torn as the tube is repeatedly inserted in the space between the canister and the tape. As such, loss of the extension tube is just a matter of time.

Another use has been affixing the tube to the canister through the use of a rubber band wrapped around the circumference of the canister and elastically retaining the spray tube to the canister. The use of a rubber band to hold the spray tube to the aerosol canister is also unsatisfactory in preventing loss because the rubber often deteriorates, causing the rubber band to break or lose its elasticity.

Another use, as illustrated in U.S. Pat. No. 5,824,040, is to affix a larger retaining tube to the canister into which the extension tube is placed. However, this adds size to the space occupied by the aerosol canister, and the retaining tube may fill up with debris and gunk after repeated use and replacement of the extension tube.

It is therefore desirable to produce an aerosol canister with an extension tube that is sized to fit a tube receiving bore that is concentric with the spray orifice of the nozzle of the aerosol canister and whose extension tube is readily accessible for immediate use on a consistent basis.

BRIEF DESCRIPTION OF THE INVENTION

The present invention in some of its embodiments provides an extension tube or applicator for an aerosol spray container in which the extension tube is magnetically attracted to the outside surface of the container.

Magnetic attraction of the tube to the outside surface of the container may be accomplished in one embodiment by constructing the tube of a ferromagnetic material constructed of an alloy containing iron. The container may also be constructed of a ferromagnetic material such that the container is magnetically attracted to the tube which may be constructed of an alloy containing iron.

The container may be of any type in which matter is held. This includes aerosol containers, spray containers, compressed gas containers, pumps and pump containers, siphoning bowls, and the like. The tube may include rigid tubes, flexible hoses, pump inflation needles, extension tube nozzle attachments for aerosol containers, siphoning tubes, and the like.

DETAILED DESCRIPTION OF THE INVENTION

Figure 1:
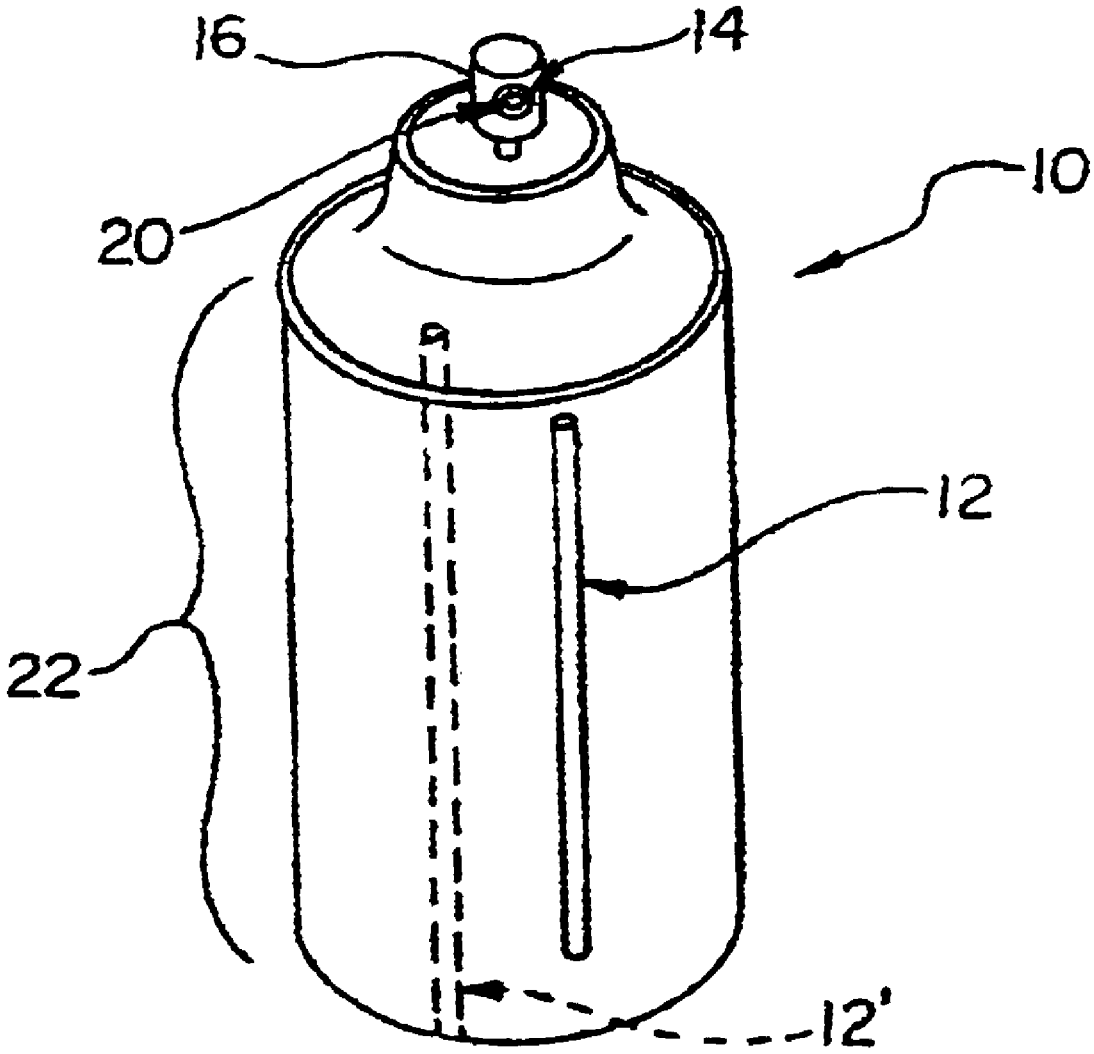
FIG. 1 is a perspective view of an embodiment of the invention showing the spray tube magnetically affixed to the outside surface of the aerosol canister.

FIG. 1 shows a perspective view of an aerosol canister or container 10 with an extension spray tube 12 magnetically affixed. Extension spray tube 12' shown in phantom has a length greater than the length of the cylindrical portion 22 of the container 10. Such aerosol spray canisters, containing solvents, lubricants (such as lubricants sold under the trademark WD-40), and the like, are in common use, with the contents of the canister being under pressure for delivery through a very small orifice 20 in a nozzle 16 atop the container 10. A valve, not shown, is interposed between the nozzle 16 and the pressurized interior of the container 10, with nozzle 16 thus being in selective communication with the pressurized interior of container 10, and the valve typically being operated by downward pressure upon the nozzle 16, thereby allowing the pressurized contents of the container 10 to sprayingly emerge from orifice 20. Nozzle 16 has an enlarged tube-receiving bore 14 concentric with orifice 20 and adapted for close-fitting receipt of one end of spray tube 12 so as to allow spray tube 12 to be an extension of nozzle 16. In a preferred embodiment the cylindrical portion 22 of container 10 is of greater length than the length of the spray tube 12.

Figure 2:
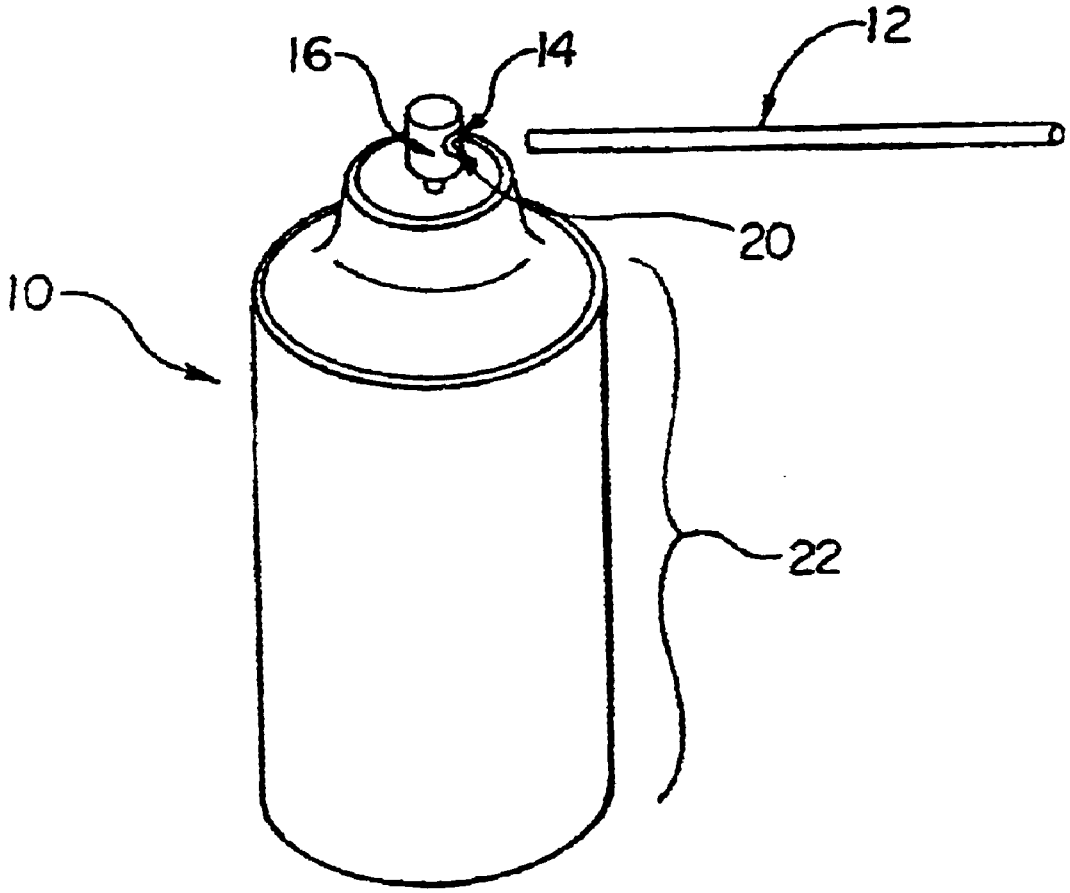
FIG. 2 is a perspective view of an embodiment of the invention showing an aerosol canister with a spray tube disengaged from the nozzle of the spray canister.

Referring to FIG. 2, a perspective view of an aerosol canister or container 10 with an extension spray tube 12 ready for insertion after removal from the side of the container 10 is shown.

Figure 3:
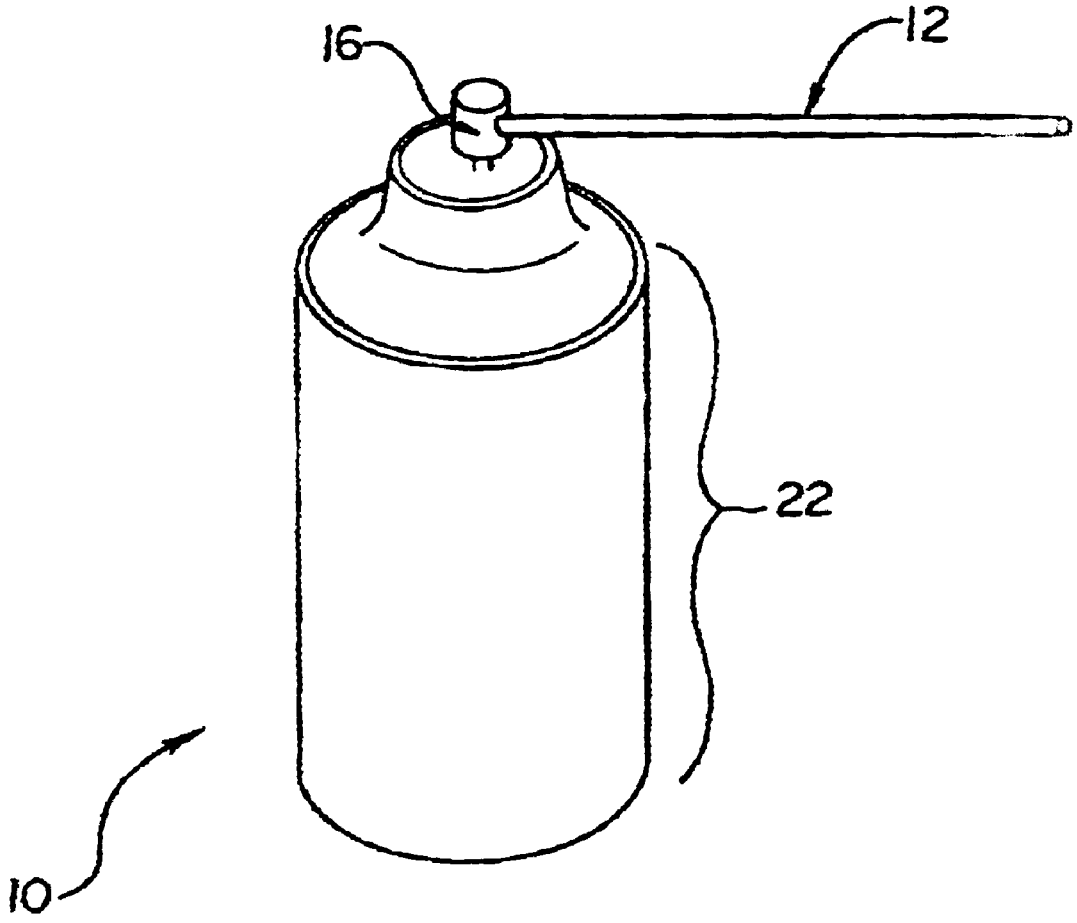
FIG. 3 is a perspective view of an embodiment of the invention showing an aerosol canister with a spray tube inserted into the tube receiving bore of the nozzle.

FIG. 3 illustrates the container 10 after insertion of the extension tube 12 into the nozzle 16.

It should be noted that the magnetic attraction may be due to either the container 10 or the extension tube 12 being magnetically constructed or may be due to both the container 10 and the extension tube 12 being magnetically constructed.

The extension tube 12 may be flexible and/or rigid. The extension tube 12 in one embodiment may also be formed of steel or iron. A flexible tube may be constructed from flexible permanent magnetic materials which are often supplied in the form of sheets or rolls and have been commercially available for many years. These materials are typically prepared by mixing a powdered ferrite material with a suitable polymeric or plastic binder into a uniform mixture. The polymeric materials are often elastomers, and the process is therefore typically accomplished through the use of sheet extrusion or calendering. The mixture is converted into strip or sheet form, providing a permanent stable product that is usually somewhat flexible, and that may be readily handled and made into elements of any desired shape by cutting and/or stamping. Alternatively, the extension tube 12 may be formed through an extrusion process and/or injection molded from magnetic materials.

The magnetic material is permanently magnetized so as to maintain a permanent attraction and consistent bond, the magnetic field being of sufficient strength for the magnetic tube to adhere to a magnetically attracted surface, such as the surface of an iron or steel sheet or container.

The magnetic material may suitably include about 75 weight % to about 95 weight %, more suitably about 80 weight % to about 92 weight %, and most suitably about 85 wt-% to about 90 wt-% of a magnetic material, suitably about 5 wt-% to about 25 wt-%, more suitably about 8 wt-% to about 20 wt-% and most suitably about 10 wt-% to about 15 wt-% of a polymeric binder. The magnetic material is generally uniformly dispersed in the polymeric binder.

As used herein, the term "magnetic" (when applied to a substrate, article, object, etc.) shall refer to any material which exhibits a permanent magnetic behavior or is readily permanently magnetized.

Magnetic materials which are particularly suitable for use herein include the ferrites having the general formula ($M^{2+}$ $O6Fe_2O_3$)$MFe_{12}O_{19}$ where M represents Ba or Sr.

Other examples of magnetic materials suitable for use herein include a rare earth-cobalt magnet of $RCO_5$ where R is one or more of the rare earth elements such as Sm or Pr, yttrium (Y), lanthanum (La), cerium (Ce), and so forth.

Other specific examples of magnetic materials include, for instance, manganese-bismuth, manganese-aluminum, and so forth.

The materials of the present invention are not limited to any particular magnetic material, and the scope of the invention is therefore not intended to be limited as such. While the above described materials find particular utility in the present invention, other materials which are readily permanently magnetized may also find utility herein.

The magnetic composition suitably includes about 70 wt-% or more of the magnetic material as to have a sufficient attractive force for practical uses. However, it is usually impractical to employ more than 95 wt-% of the magnetic material because of production concerns, and also because of the difficulty of retaining more than this in the binder material. Furthermore, including more than about 95 wt-% of the magnetic material may lead to a rougher surface. The magnetic material is often supplied in a powder form.

The magnetic strength of the finished product is a function of the amount of magnetic material or powder in the mix, the surface area, thickness, and method of magnetization (e.g. whether it is aligned or not).

The thermoplastic material, often referred to in the industry as a thermoplastic binder, suitable for use in the process of the present invention may include any polymeric material that is readily processible with the magnetic material on, for instance, the thermoplastic or hot melt processing equipment as described in detail below. Such thermoplastic materials include both thermoplastic elastomers and non-elastomers or any mixture thereof.

The thermoplastic composition may be selected based on, for one, the type of printable substrate which is being used for the canister, and the adhesion obtained between the thermoplastic composition and the printable substrate.

Examples of thermoplastic elastomers suitable for use herein include, but are not limited to, natural and synthetic rubbers and rubbery block copolymers, such as butyl rubber, neoprene, ethylene-propylene copolymers (EPM), ethylene-propylene-diene polymers (EPDM), polyisobutylene, polybutadiene, polyisoprene, styrene-butadiene (SBR), styrene-butadiene-styrene (SBS), styrene-ethylenebutylene-styrene (SEBS), styrene-isoprene-styrene (SIS), styrene-isoprene (SI), styrene-ethylene/propylene (SEP), polyester elastomers, polyurethane elastomers, nitrile, nylon, nylon 6/6, polyphenylsulfide or PPS, cross-linked nitrile rubber, and/or cross-linked polymers, to mention only a few, and mixtures thereof. Where appropriate, included within the scope of this invention are any copolymers of the above described materials. The materials selected may be chosen for retentive properties of the composition following prolonged exposure to solvents being utilized within the canister. The duration of utility of the extension tube 12 and canister is thereby maximized.

Examples of suitable commercially available thermoplastic elastomers such as SBS, SEBS, or SIS copolymers include KRATON® G (SEBS or SEP) and KRATON® D (SIS or SBS) block copolymers available from Kraton Polymers; VECTOR® (SIS or SBS) block copolymers available from Dexco Chemical Co.; and FINAPRENE® (SIS or SBS) block copolymers available from Atofina.

Some examples of non-elastomeric polymers include, but are not limited to, polyolefins including polyethylene, polypropylene, polybutylene and copolymers and terpolymers thereof such as ethylene vinyl acetate copolymers (EVA), ethylene n-butyl acrylates (EnBA), ethylene methyl (meth) acrylates including ethylene methyl acrylates (EMA), ethylene ethyl (meth) acrylates including ethylene ethyl acrylates (EEA), interpolymers of ethylene with at least one $C_3$ to $C_{20}$ alphaolefin, polyamides, polyesters, polyurethanes, to mention only a few, and mixtures thereof Where appropriate, copolymers of the above described materials also find utility herein.

Examples of polymers useful herein may be found in U.S. Pat. No. 6,262,174 incorporated by reference herein in its entirety. Polymeric compositions exhibiting high hot tack have been found to be particularly suitable for use herein.

Examples of commercially available non-elastomeric polymers include EnBA copolymers available from such companies as Atofina under the tradename of LOTRYL®, from ExxonMobil under the tradename of ESCORENE®, from Du Pont de Nemours & Co. under the tradename of ELVALOY®; EMA copolymers available from Exxon Chemical Co. under the tradename of OPTEMA®; EVA copolymers are available from Du Pont under the tradename of ELVAX® and from Equistar under the tradename of ULTRATHENE® to name only a few.

In some embodiments of the present invention, the binder includes at least one polyolefin or polyalphaolefin, or a copolymer or terpolymer thereof. Examples of useful polyolefins include, but are not limited to, amorphous (i.e. atactic) polyalphaolefins (APAO) including amorphous propylene homopolymers, propylene/ethylene copolymers, propylene/butylene copolymers and propylene/ethylene/butylene terpolymers; isotactic polyalphaolefins; and linear or substantially linear interpolymers of ethylene and at least one alpha-olefin including, for instance, ethylene and 1-octene, ethylene and 1-butene, ethylene and 1-hexene, ethylene and 1-pentene, ethylene and 1-heptene, and ethylene and 4-methyl-1-pentene and so forth. In some embodiments, it may be preferable to employ a small amount of another polymer in combination with the polyalphaolefin such as maleic anhydride grafted polymers which have been used to improve wetting and adhesion. Other chemical grafting can be used, but maleic anhydride is by far the most common. Usually only a few percent in grafting (1–5%) are used and most tend to be ethylene or propylene copolymers.

The terms "polyolefin" and "polyalphaolefin" are often used interchangeably, and in fact, are often used interchangeably to describe amorphous polypropylenes (homo-, co- and terpolymers). For a detailed description of such materials, see U.S. Pat. No. 5,482,982, U.S. Pat. No. 5,478,891 and U.S. Pat. Nos. 5,397,843, 4,857,594, each of which is incorporated by reference herein in its entirety.

The term "alpha" is used to denote the position of a substituting atom or group in an organic compound.

As used herein, the terms "copolymer" and "interpolymer" shall be used to refer to polymers having two or more different comonomers, e.g. copolymer, terpolymer, and so forth.

Examples of commercially available amorphous polyolefins suitable for use herein include those available under the tradename of REXTAC® from Huntsman Polymers including polypropylene homopolymers, propylene/ethylene copolymers and propylene-butene copolymers; VESTOPLAST® APAOs available from Hüls including homopolymers and copolymers, as well as terpolymers of propylene/ethylene/butene; as well as those available from Rexene and those available under the tradename of EASTOFLEX® available from Eastman Chemical Co. in Kingsport, Tenn.

Examples of copolymers of a polyolefin and at least one alpha-olefin include metallocene catalyzed polyolefins (interpolymers of ethylene and at least one alphaolefin) commercially available from Exxon under the tradename EXXACT®, and from Dupont Dow Elastomers under the tradename ENGAGE®, and from Dow under the tradename AFFINITY®.

Any of the polymeric materials useful herein may be used in combination with one another. Furthermore, other polymeric materials not specifically described herein also find utility in the present invention. The list described above is intended for illustrative purposes only, and is not intended to limit the scope of the present invention. One of skill in the art would understand that there are vast numbers of polymeric materials available that may find utility herein.

Plasticizers are available from many sources and include plasticizing oils, for instance. Plasticizing oils are often petroleum based and are available from various petroleum companies.

Waxes may also be optionally added to the compositions to lower the melt viscosity and/or change rheological characteristics.

Other optional ingredients include, but are not limited to, antioxidants, dyes or pigments, UV agents, and so forth. Such optional ingredients are known to those of skill in the art and are typically added in low concentrations which do not adversely affect the physical characteristics of the composition. The list of materials described above is intended for illustrative purposes only, and is by no means exclusive of the materials which may be employed in the magnetic composition herein, and as such is not intended as a limit on the scope of the invention herein.

It should be noted that following manufacture of the canister and extension tube, the extension tube in addition to magnetic attraction to the exterior surface of the canister may be supplementally mechanically attached thereto by cellophane tape and/or rubber bands during shipping of the invention and/or prior to the use of the canister and magnetic tube invention.

Although the present invention has been described and illustrated with respect to a preferred embodiment and a preferred use therefore, it is not to be so limited since modifications and changes can be made therein which are within the full intended scope of the invention.

I claim:

1. A combination container and applicator comprising:

a) a container having an outside surface and anti interior; and b) said applicator comprising, a tube formed of ferromagnetic material, said tube being constructed and arranged to be magnetically attracted to the outside surface of the container for releasable affixation to said outside surface;

wherein the container is constructed and arranged of ferromagnetic material, wherein said container is magnetically attracted to the tube.

2. The combination of claim 1, said container comprising a nozzle.

3. The combination of claim 2, said tube being constructed and arranged to be coupled to said nozzle.

4. The combination of claim 2, wherein the container is under pressure.

5. The combination of claim 1, wherein the tube is constructed of plastic ferrite material.

6. The combination of claim 1, wherein the tube is constructed of flexible magnetic material.

7. The combination of claim 1, wherein the tube is constructed of iron material.

8. The combination of claim 1, wherein the tube is constructed of steel material.

9. The combination of claim 1, the container comprising a cylindrical portion having a first length dimension, the tube having a second length dimension which is shorter than the first length dimension.

10. A combination container and applicator comprising:

a) a container having an outside surface and an interior; and b) said applicator comprising, a tube formed of ferromagnetic materal, said tube being constructed and arranged to be magically attracted to the outside surface of the container for releasable affixation to said outside surface;

The container comprising a cylindrical portion having a first length dimension, said tube having a second length dimension which is longer than the first length dimension.

11. A method for use of a canister and an applicator comprising:

a) constructing a canister having an exterior surface, said exterior surface being formed of a material susceptible to magnetic attraction, said canister having contents and a nozzle constructed and arranged to dispense said contents;

b) forming an applicator comprising a tube formed of material susceptible to magnetic attraction, said tube being constructed and arranged to be magnetically attracted to said exterior surface of said canister, said tube being further constructed and arranged to be releasably affixed to said exterior surface of said canister;

c) attaching said tube to said exterior surface of said canister for magnetic attraction thereto;

d) transporting said canister and said applicator to a desired location;

e) removing said tube from said exterior surface of said canister and coupling said tube to said nozzle; and f) dispensing said contents through said tube.

* * * * *

UNITED STATES PATENT AND TRADEMARK OFFICE

CERTIFICATE OF CORRECTION

PATENT NO. : 6,659,313 B1
DATED : December 9, 2003
INVENTOR(S) : Alex MacMurdo

It is certified that error appears in the above-identified patent and that said Letters Patent is hereby corrected as shown below:

Column 6,
Line 40, delete “anti” and insert -- an --.

Column 7,
Line 9, delete “T” and insert -- t --.

Signed and Sealed this

Twenty-second Day of November, 2005

JON W. DUDAS
*Director of the United States Patent and Trademark Office*